United States Patent [19]

Smith, Sr.

[11] 4,052,689

[45] Oct. 4, 1977

[54] WIRE SPRING FUSE HOLDER WITH PIGTAIL LEADS

[75] Inventor: Dalton T. Smith, Sr., Meadville, Pa.

[73] Assignee: Oneida Electronic Mfg. Co. Inc., Meadville, Pa.

[21] Appl. No.: 489,091

[22] Filed: July 17, 1974

[51] Int. Cl.[2] ..... H01H 85/50

[52] U.S. Cl. ..... 337/215; 337/251

[58] Field of Search ..... 337/208, 209, 213, 215, 337/227, 231, 237, 251, 252; 317/101 CC; 339/147 R, 147 P, 256 S, 258 F, 256 R, 252 F, 253 F

[56] References Cited

U.S. PATENT DOCUMENTS

| | | | |
|---|---|---|---|
| 885,864 | 4/1908 | Read | 339/256 S |
| 2,902,629 | 9/1959 | Little et al. | 339/256 S X |
| 3,058,083 | 10/1962 | Schneider | 339/256 S X |
| 3,123,696 | 3/1964 | McAuster | 337/251 |
| 3,566,192 | 2/1971 | Stump | 317/101 CC |
| 3,569,790 | 3/1971 | Jenik | 317/101 CC |

FOREIGN PATENT DOCUMENTS

| | | | |
|---|---|---|---|
| 503,359 | 4/1948 | Canada | 337/251 |
| 224,736 | 12/1962 | Germany | 337/215 |

*Primary Examiner*—George Harris

[57] ABSTRACT

This specification discloses a terminal and a pigtail wire combination for holding small fuses, made up of a single piece of wire. The wire may be considered as having a first part and a second part integrally connected to the first part. The first part is wound to form a tightly wound hollow cylindrical coil having a plurality of turns disposed in engagement with each other. The second straight part of the wire is tangent to the last turn on one end of the coil and extends across the coil parallel to the diameter of the coil and terminates at a substantial distance from the coil. A pigtail wire can be soldered to the terminal and a fuse can be inserted in the coil. A pair of these terminals can be spaced from each other and both soldered to pigtail wires to support both ends of a suitable fuse. In the case of the fuse, the internal diameter of the cylinder formed by the wire is slightly smaller than the external diameter of the fuse terminals.

1 Claim, 3 Drawing Figures

WIRE SPRING FUSE HOLDER WITH PIGTAIL LEADS

OBJECTS OF THE INVENTION

It is an object of the invention to provide an improved terminal.

Another object of the invention is to provide an improved combination pigtail and terminal.

Another object of the invention is to provide a terminal and fuse combination that is simple in construction, economical to manufacture, and simple and efficient to use.

With the above and other objects in view, the present invention consists of the combination and arrangement of parts hereinafter more fully described, illustrated in the accompanying drawing and more particularly pointed out in the appended claims, it being understood that changes may be made in the form, size, proportions, and minor details of construction without departing from the spirit or sacrificing any of the advantages of the invention.

GENERAL DESCRIPTION OF THE DRAWINGS

DETAILED DESCRIPTION OF THE DRAWINGS

Figure 1:
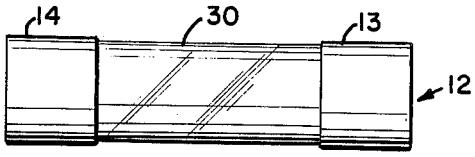
FIG. 1 is a side view of a cartridge type fuse that may be used with a terminal and pigtail combination making up the invention.
Figure 2:
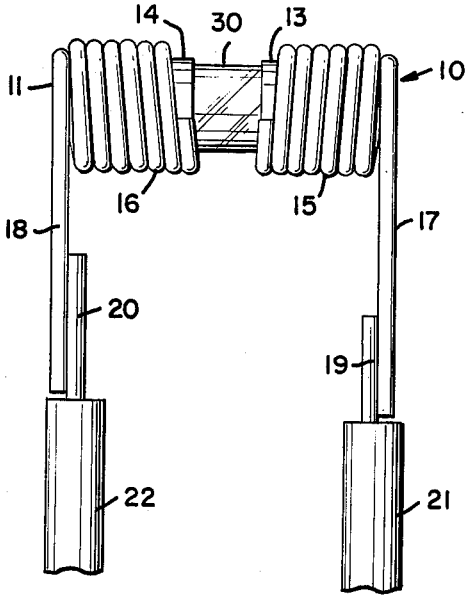
FIG. 2 is a side view of two of the terminals according to the invention supporting a cartridge type fuse such as shown in FIG. 1 and having the ends of the terminals fixed to conductor wires or pigtail wires.
Figure 3:
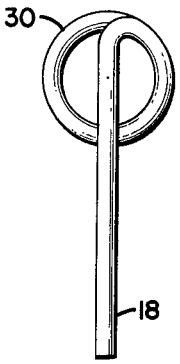
FIG. 3 is an end view of one of the terminals shown in FIG. 2.

Now with more particular reference to the drawings, the end caps 10 and 11 support a cartridge type fuse 12 between them. The fuse 12 is similar to the fuse shown in FIG. 1 but the intermediate part of the fuse shown in FIG. 2 is made shorter for convenience of showing. The fuse typically has terminals 13 and 14 which may be metallic with a fuseable wire supported between the terminals inside the body 30. The body 30 may be glass or the like. The end caps 10 and 11 are inserted in the coils 15 and 16 respectively and since the internal diameter of the coils are slightly smaller than the outside diameter of the terminals 13 and 14, the coils will make electrical contact with the coils. The coils will firmly grip the terminals of the fuse and maintain them in electrical contact.

The straight parts 17 and 18 of the two terminals are made from the same pieces of wire as the coils 15 and 16. The straight parts 17 and 18 are an integral part of the coils and are fixed to the pigtails 19 and 20 respectively by suitable soldering or the like. The wires are shown having insulation materials 21 and 22 of a type familiar to those skilled in the art.

In use, the operator will replace the ordinary permanently installed pigtail fuses by merely soldering the leads or straight parts of the new spring holder terminals to the stubs of the removed pigtail fuse wires. The spring holders have been designed to accommodate television, radio, high-fi and most other electrical device fuses. They can also be used in automotive or other suitable places. These fuse holders eliminate the need for pulling chassis from televisions and removing other parts such as tuners to replace fuses and greatly reduce the possibilities of printed circuit boards. The terminals according to the invention can be made of spring wire, copper plated to improve the electrical conductive characteristics and anti-corrosion characteristics.

The foregoing specification sets forth the invention in its preferred practical forms but the structure shown is capable of modification within a range of equivalents without departing from the invention which is to be understood is broadly novel as is commensurate with the appended claims.

The embodiments of the invention in which an exclusive property or privilege is claimed are defined as follows:

1. A fuse and pigtail wire combination comprising, a hollow cylindrical fuse body made of non-conducting material having a hollow cylindrical cuplike terminal made of conducting material and disposed on each end of said cylindrical body, said terminal and pigtail being made of a single wire wound into a spiral, each said pigtail wire having a first part and a second part integrally connected to said first part, said first part being wound to form a tight coil on said cuplike terminal made of conductive material comprising a plurality of turns of slightly smaller internal diameter than the outside diameter of said cuplike terminals whereby said coil will grip the caps and make electrical contact with said caps disposed in the form of a hollow cylinder receiving a said cuplike terminal, said second part comprising a straight section of wire disposed parallel to a diameter of said coil and extending diametrically across one end of said coil and terminating a substantial distance from said coil, each said cuplike terminal member receiving an end of said hollow body, said second part of each said pigtail wire being soldered to a straight pigtail wire.

* * * * *

UNITED STATES PATENT OFFICE

CERTIFICATE OF CORRECTION

Patent No. 4,052,689 Dated October 4, 1977

Inventor(s) Dalton L. Smith, Sr.

It is certified that error appears in the above-identified patent and that said Letters Patent are hereby corrected as shown below:

The inventor's name should be corrected to read

-- Dalton L. Smith, Sr. --.

Signed and Sealed this

*Third* Day of *January 1978*

[SEAL]

*Attest:*

RUTH C. MASON
*Attesting Officer*

LUTRELLE F. PARKER
*Acting Commissioner of Patents and Trademarks*